US009409430B2

(12) United States Patent
Arimura

(10) Patent No.: US 9,409,430 B2
(45) Date of Patent: Aug. 9, 2016

(54) INKJET PRINTER

(71) Applicant: RISO KAGAKU CORPORATION, Tokyo (JP)

(72) Inventor: Eijiro Arimura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/970,877

(22) Filed: Dec. 16, 2015

(65) Prior Publication Data

US 2016/0185144 A1 Jun. 30, 2016

(30) Foreign Application Priority Data

Dec. 26, 2014 (JP) ..... 2014-265089

(51) Int. Cl.
*B41J 2/01* (2006.01)
*B41J 29/377* (2006.01)
*B41J 2/14* (2006.01)

(52) U.S. Cl.
CPC . *B41J 29/377* (2013.01); *B41J 2/14* (2013.01)

(58) Field of Classification Search
CPC ..... B41J 29/377; B41J 2202/08; B41J 2002/16555; B41J 11/008; B41J 11/0085
See application file for complete search history.

(56) References Cited

U.S. PATENT DOCUMENTS 6,074,056 A * 6/2000 Kubo ..... B41J 13/226 347/104
8,398,230 B2 * 3/2013 Matsuhashi ..... B41J 2/01 347/102
8,807,732 B2 * 8/2014 Onozawa ..... B41J 11/002 347/101

FOREIGN PATENT DOCUMENTS

JP 2010-264752 11/2010

* cited by examiner

*Primary Examiner* — Lamson Nguyen
(74) *Attorney, Agent, or Firm* — Greenblum & Bernstein, P.L.C.

(57) ABSTRACT

A first chamber has a plurality of first ventilation holes of a same size arranged on extended lines of a plurality of head arrays respectively. A second chamber faces the first chamber across the plurality of head arrays and has a plurality of second ventilation holes of a same size facing the plurality of first ventilation holes. Cross-sectional areas of an internal air flow passage in the first chamber at positions of the first ventilation holes decrease with an increase in a distance of the first ventilation holes from a first end of the first chamber. Cross-sectional areas of an internal air flow passage in the second chamber at positions of the second ventilation holes decrease with an increase in a distance of the second ventilation holes from a second end of the second chamber on the same side of the first end.

1 Claim, 7 Drawing Sheets

3B
46
22B
54
53a
53B
43
44a
21
L4
L3
44
45
31
41a
52
L1
L2
31
41
42a
42a
51a
51B
32
42
UP
RR
RT
LT
FT
DN

INKJET PRINTER

CROSS REFERENCE TO RELATED APPLICATION

This application is based upon and claims the benefit of priority from the prior Japanese Patent Application No. 2014-265089, filed on Dec. 26, 2014, the entire contents of which are incorporated herein by reference.

BACKGROUND

1. Technical Field

The disclosure relates to an inkjet printer configured to perform printing by ejecting inks from inkjet heads.

2. Related Art

When inkjet heads are driven in an inkjet printer, piezoelectric elements, a drive circuit, and the like generate heat. A temperature increase due to this generated heat causes failures of the inkjet heads and the like. Accordingly, the inkjet heads need to be cooled.

Japanese Patent Application Publication No. 2010-264752 proposes an inkjet printer in which two fans are arranged across head arrays each including inkjet heads aligned. In the inkjet printer, one of the fans blows a cooling wind to the inkjet heads, while the other fan sucks the cooling wind. The inkjet heads are thereby cooled.

SUMMARY

In the inkjet printer of Japanese Patent Application Publication No. 2010-264752, when the number of head arrays is increased, the number of fans also needs to be increased in order to evenly cool the head arrays and prevent uneven cooling of the inkjet heads. However, this leads to an increase in an apparatus size.

An object of the disclosure is to provide an inkjet printer which can reduce unevenness in cooling of inkjet heads while suppressing an increase in an apparatus size.

An inkjet printer in accordance with some embodiments includes: a plurality of inkjet heads arranged in a plurality of head arrays; a first chamber having a plurality of first ventilation holes of a same size arranged on extended lines of the plurality of head arrays respectively, the first chamber extending in a direction orthogonal to the extended lines; a blow fan configured to send air into the first chamber from a first end of the first chamber; a second chamber facing the first chamber across the plurality of head arrays and having a plurality of second ventilation holes of a same size facing the plurality of first ventilation holes, the second chamber extending in the direction orthogonal to the extended lines; and a suction fan configured to suck air from a second end of the second chamber on a same side as a side of the first end of the first chamber. The first chamber has a shape with cross-sectional areas of an internal air flow passage in the first chamber at positions of the first ventilation holes decreasing with an increase in a distance of the first ventilation holes from the first end. The second chamber has a shape with cross-sectional areas of an internal air flow passage in the second chamber at positions of the second ventilation holes decreasing with an increase in a distance of the second ventilation holes from the second end.

In the configuration described above, the first chamber has such a shape that the internal air flow passage has cross-sectional areas at the positions of the first ventilation holes decreasing with the increase in the distance of the first ventilation holes from the first end (the blow fan). Moreover, the second chamber has such a shape that the internal air flow passage has cross-sectional areas at the positions of the second ventilation holes decreasing with the increase in the distance of the second ventilation holes from the second end (the suction fan). This can reduce unevenness in an air speed of a cooling wind among the head arrays. As a result, unevenness in cooling of the inkjet heads can be reduced. Moreover, since the inkjet heads are cooled only by one fan and one chamber on each of the blow side and the suction side, an increase in an apparatus size can be suppressed. Thus, the configuration described above can reduce the unevenness in the cooling of the inkjet heads while suppressing the increase in the apparatus size.

DETAILED DESCRIPTION

Figure 1:
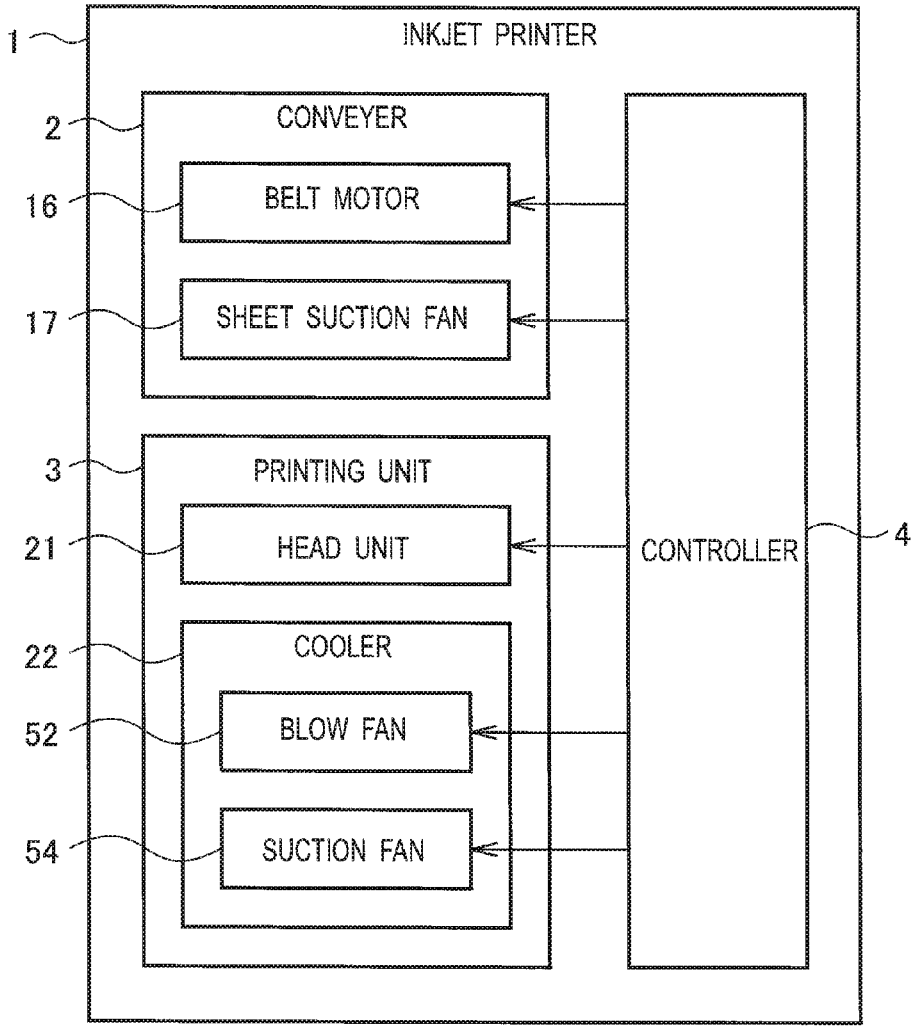
FIG. 1 is a block diagram illustrating a configuration of an inkjet printer in a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
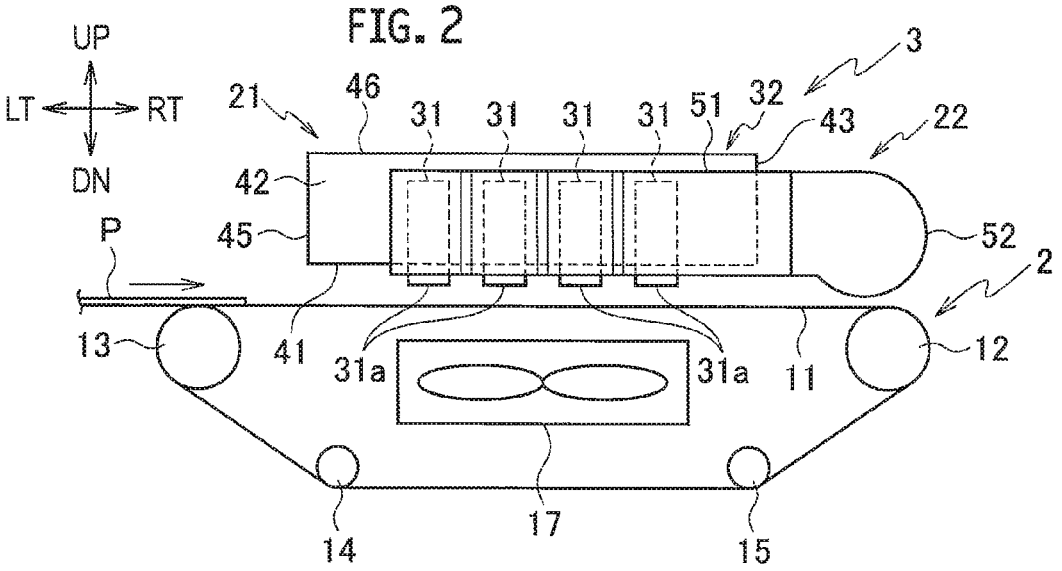
FIG. 2 is a schematic configuration diagram of a conveyer and a printing unit of the inkjet printer illustrated in FIG. 1.
Figure 3:
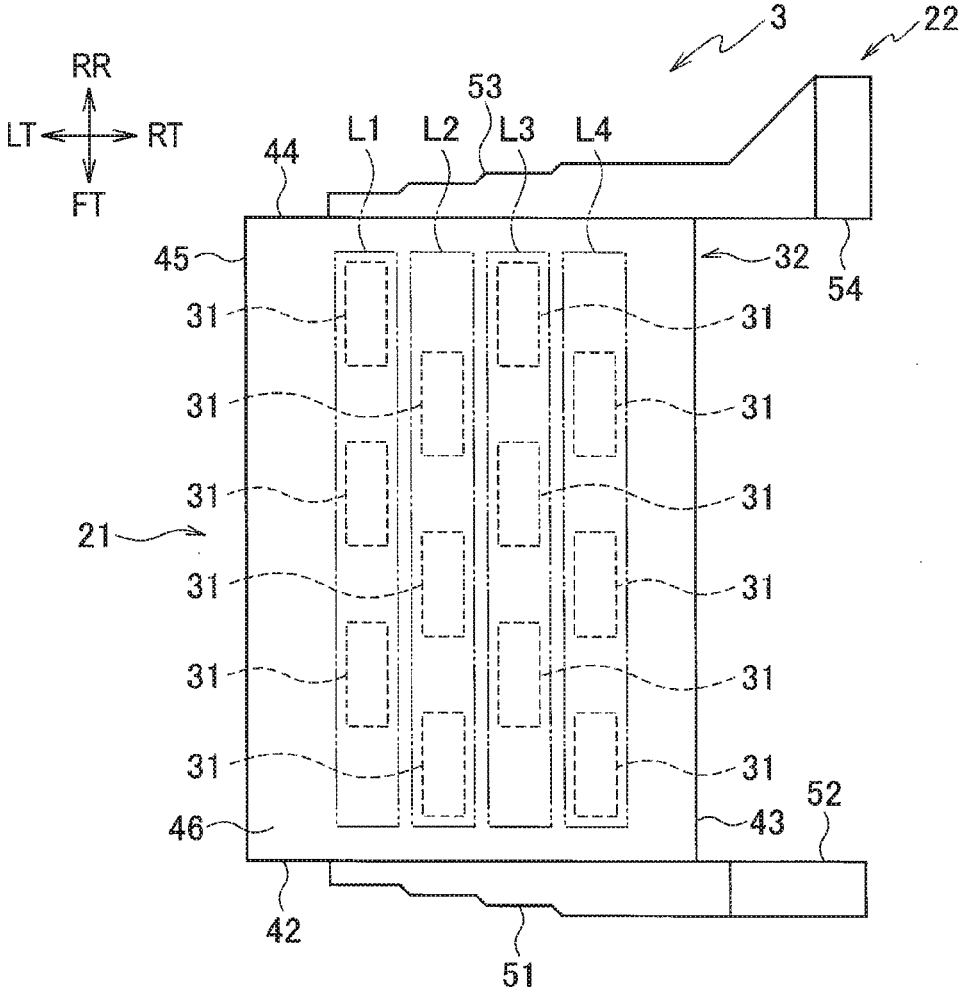
FIG. 3 is a plan view of the printing unit in the inkjet printer illustrated in FIG. 1.
Figure 4:
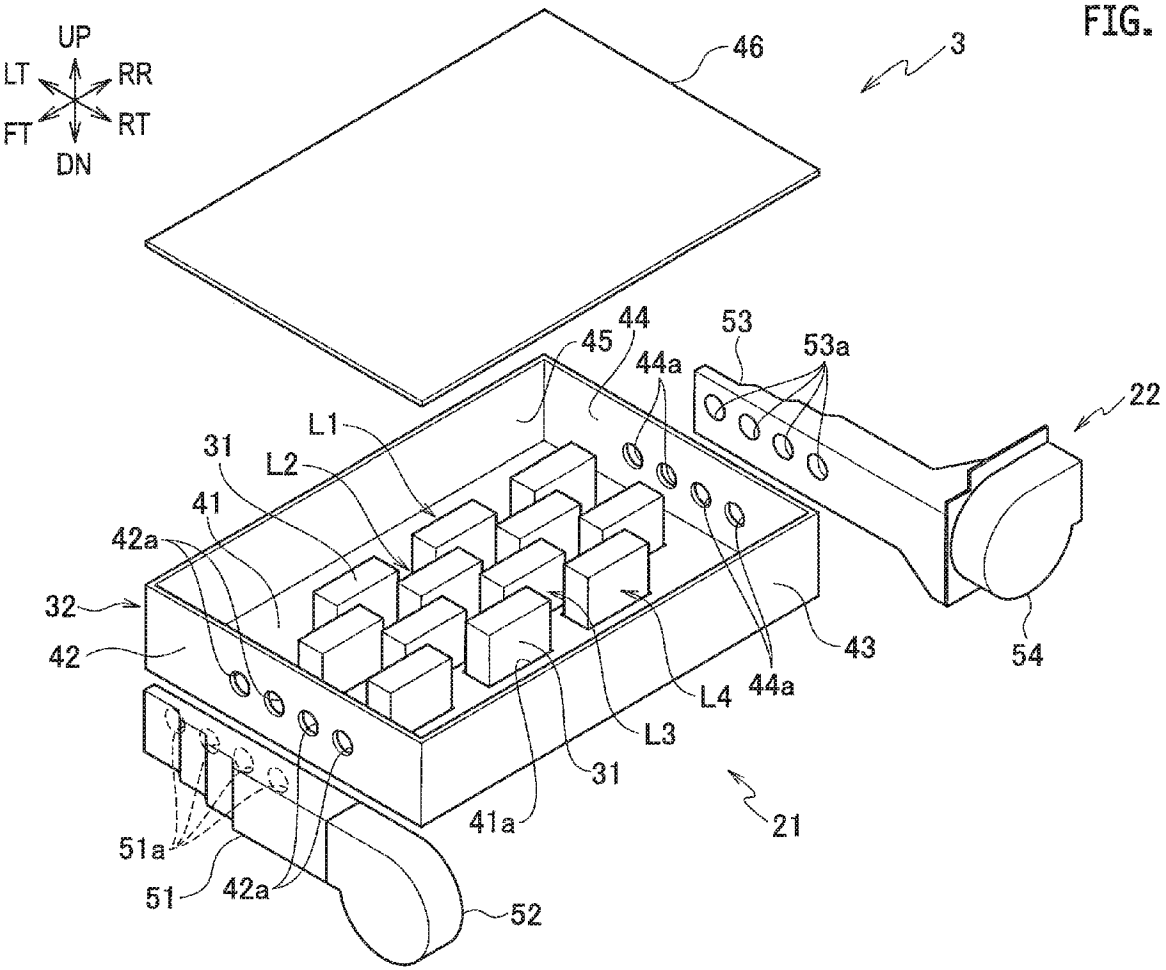
FIG. 4 is an exploded perspective view of the printing unit in the inkjet printer illustrated in FIG. 1.

FIG. 1 is a block diagram illustrating a configuration of an inkjet printer in a first embodiment. FIG. 2 is a schematic configuration diagram of a conveyer and a printing unit in the inkjet printer illustrated in FIG. 1. FIG. 3 is a plan view of the printing unit in the inkjet printer illustrated in FIG. 1. FIG. 4 is an exploded perspective view of the printing unit in the inkjet printer illustrated in FIG. 1.

In FIGS. 2 to 9, directions of right, left, up, down, front and rear are denoted by RT, LT, UP, DN, FT, and RR, respectively. In FIGS. 2 to 9, a direction from left to right is a conveying direction of sheets P which are printing media.

As illustrated in FIG. 1, the inkjet printer 1 in the first embodiment includes a conveyer 2, a printing unit 3, and a controller 4.

The conveyer 2 conveys the sheets P. As illustrated in FIGS. 1 and 2, the conveyer 2 includes a transfer belt 11, a drive roller 12, driven rollers 13, 14, and 15, a belt motor 16, and a sheet suction fan 17.

The transfer belt 11 conveys the sheets P while sucking and holding the sheets P thereon. The transfer belt 11 is an annular belt wound around the drive roller 12 and the driven rollers 13 to 15. The transfer belt 11 is flexible and is made of a material such as rubber or resin which generates an appropriate degree of friction force between the sheets P and the belt. Multiple belt holes (not illustrated) are also formed in the transfer belt 11. The transfer belt 11 sucks and holds the sheets P on the top surface by means of suction force generated at the belt holes by drive of the sheet suction fan 17. The transfer belt 11 rotates clockwise in FIG. 2 to convey the sucked and held sheets P to the right.

The drive roller 12 rotates the transfer belt 11 clockwise in FIG. 2.

The driven rollers 13 to 15 support the transfer belt 11 together with the drive roller 12. The driven rollers 13 to 15 are driven by the drive roller 12 via the transfer belt 11. The driven roller 13 is arranged on the left side of the drive roller 12 at the same height as the drive roller 12. The driven rollers 14 and 15 are arranged at substantially the same height below the drive roller 12 and the driven roller 13 while being spaced away from each other in a left-right direction.

The belt motor 16 rotationally drives the drive roller 12.

The sheet suction fan 17 generates a downward air flow. The sheet suction fan 17 thus sucks air through the belt holes of the transfer belt 11 and generates negative pressure at the belt holes to suck the sheets P such that the sheets P are held on the transfer belt 11. The sheet suction fan 17 is arranged in a region surrounded by the annular transfer belt 11.

The printing unit 3 prints images on the sheets P conveyed by the conveyer 2. The printing unit 3 is arranged above the conveyer 2. As illustrated in FIGS. 1 to 4, the printing unit 3 includes a head unit 21 and a cooler 22.

The head unit 21 ejects inks to the sheets P conveyed by the conveyer 2 to print images. The head unit 21 includes multiple inkjet heads 31 and a head holder 32.

Each of the inkjet heads 31 has a nozzle surface 31*a* in which nozzles (not illustrated) are opened. The nozzle surface 31*a* is a bottom surface of the inkjet head 31 which faces the sheets P conveyed by the transfer belt 11. The multiple nozzles are formed in the nozzle surface 31*a* to be arranged in a front-rear direction (scanning direction). The inkjet heads 31 eject the inks supplied through ink supply routes (not illustrated), from the nozzles.

The multiple inkjet heads 31 are arranged to form multiple head arrays. In the embodiment, as illustrated in FIG. 3, twelve inkjet heads 31 form four head arrays L1 to L4 arranged in a left-right direction in parallel to one another.

Each of the head arrays L1 to L4 include three inkjet heads 31 which are arranged at equal intervals in the front-rear direction (scanning direction). Each of the inkjet heads 31 in the head arrays L1 to L4 is arranged to be shifted in the front-rear direction by half a pitch relative to the corresponding inkjet head 31 in the adjacent head array. The twelve inkjet heads 31 are thereby arranged in a zigzag pattern. The inkjet heads 31 in the head arrays L1 and L2 eject the same color of ink. The inkjet heads 31 in the head arrays L3 and L4 eject the same color of ink.

The head holder 32 holds the inkjet heads 31. The head holder 32 is a box formed in a hollow rectangular-solid shape. As illustrated in FIG. 4, the head holder 32 has a bottom plate 41, side plates 42 to 45, and a top plate 46.

The bottom plate 41 holds the inkjet heads 31 such that the inkjet heads 31 are fixed. The bottom plate 41 is formed in a rectangular shape. Attachment openings 41*a* for attaching the inkjet heads 31 are formed as many as the inkjet heads 31. The inkjet heads 31 are inserted into and fixed to the attachment openings 41*a* such that the nozzle surfaces 31*a* protrude downward from a bottom surface of the bottom plate 41.

The side plates 42, 43, 44, and 45 form front, right, rear, and left side walls of the head holder 32, respectively. The side plates 42 to 45 are integrally formed and stand upright at a periphery of the bottom plate 41.

Four ventilation holes 42*a* are formed in the front side plate 42. The ventilation holes 42*a* are air inlets to the head holder 32 used when air is blown from a blow chamber 51 to be described later, to the inkjet heads 31. The four ventilation holes 42*a* are formed respectively on extend lines of the head arrays L1 to L4. The four ventilation holes 42*a* all have the same size.

Four ventilation holes 44*a* are formed in the rear side plate 44. The ventilation holes 44*a* are air outlets used when air is sucked out from the head holder 32 through a suction chamber 53 to be described later. The four ventilation holes 44*a* are arranged at positions facing the four ventilation holes 42*a* of the front side plate 42, respectively. In other words, the four ventilation holes 44*a* are formed respectively on the extend lines of the head arrays L1 to L4. The four ventilation holes 44*a* all have the same size.

The top plate 46 is a lid which closes an opening at upper ends of side walls formed by the side plates 42 to 45. The top plate 46 is formed in a rectangular shape.

The cooler 22 cools the inkjet heads 31. The cooler 22 includes the blow chamber (first chamber) 51, a blow fan 52, the suction chamber (second chamber) 53, and a suction fan 54.

The blow chamber 51 forms an air flow passage between the blow fan 52 and the head holder 32. The blow chamber 51 has an elongated shape extending in the left-right direction which is a direction orthogonal to the head arrays L1 to L4, and is formed to be hollow. The blow chamber 51 is arranged on the front side plate 42 of the head holder 32. Four ventilation holes 51*a* are formed on a surface of the blow chamber 51 which comes into contact with the side plate 42.

The ventilation holes 51*a* are air outlets from the blow chamber 51 used when air is blown to the inkjet heads 31. The ventilation holes 51*a* are arranged at positions corresponding to the ventilation holes 42*a* of the side plate 42. In other words, the four ventilation holes 51*a* are formed respectively on the extend lines of the head arrays L1 to L4. The four ventilation holes 51*a* all have the same size.

The blow chamber 51 has such a shape that the internal air flow passage has cross-sectional areas at the positions of the ventilation holes 51*a* decreasing with an increase in the distance of the ventilation hole 51*a* from the blow fan 52. Specifically, as illustrated in FIGS. 3 and 4, the blow chamber 51 is formed in such a shape that the depth of the blow chamber 51 in the front-rear direction at the position of each ventilation hole 51*a* decreases toward the left side. The depth of the blow chamber 51 in the front-rear direction at the position of each of the ventilation holes 51*a* is designed such that speeds of air flows from the respective ventilation holes 51*a* to the head arrays L1 to L4 are even.

The blow fan 52 sends air into the blow chamber 51 from a right end of the blow chamber 51. The blow fan 52 thereby blows air to the inkjet heads 31 via the blow chamber 51.

The suction chamber 53 forms an air flow passage between the head holder 32 and the suction fan 54. The suction chamber 53 has an elongated shape extending in the left-right direction, and is formed to be hollow. The suction chamber 53 is arranged on the rear side plate 44 of the head holder 32. In other words, the suction chamber 53 is arranged to face the blow chamber 51 across the head arrays L1 to L4 and the head holder 32. Four ventilation holes 53*a* are formed on a surface of the suction chamber 53 which comes into contact with the side plate 44.

The ventilation holes 53*a* are air inlets to the suction chamber 53 used when air is sucked out from the head holder 32. The ventilation holes 53*a* are arranged at positions corresponding to the ventilation holes 44*a* of the side plate 44. In other words, the four ventilation holes 53*a* are formed respectively on the extended lines of the head arrays L1 to L4. To put it differently, the ventilation holes 53*a* are arranged to face the ventilation holes 51*a* of the blow chamber 51.

The suction chamber 53 has such a shape that the internal air flow passage has cross-sectional areas at positions of the ventilation holes 53*a* decreasing with an increase in the distance of the ventilation holes 53*a* from the suction fan 54. Specifically, as illustrated in FIGS. 3 and 4, the suction chamber 53 is formed in such a shape that the depth of the suction chamber 53 in the front-rear direction at the position of each ventilation hole 53*a* decreases toward the left side. The depth of the suction chamber 53 in the front-rear direction at the position of each of the ventilation holes 53*a* is designed such that speeds of air flows sucked in from the respective ventilation holes 53*a* are even.

The suction fan 54 sucks air from the right end of the suction chamber 53 which is an end on the same side as the side of the blow chamber 51 on which the blow fan 52 is arranged. The suction fan 54 thereby sucks air from the head holder 32 via the suction chamber 53.

The controller 4 controls operations of various units in the inkjet printer 1. The controller 4 includes a CPU, a RAM, a ROM, a hard disk drive, and the like.

Specifically, in printing, the controller 4 causes the inkjet heads 31 to eject the inks while causing the conveyer 2 to convey the sheets P, and also performs control such that the cooler 22 cools the inkjet heads 31.

Next, operations of the inkjet printer 1 are described.

When receiving a print job, the controller 4 causes the belt motor 16 to activate the drive roller 12. Rotation drive of the transfer belt 11 is thereby started.

Moreover, the controller 4 activates the sheet suction fan 17. The sheet suction fan 17 thereby sucks air through the belt holes in the transfer belt 11 and the suction force is generated at the belt holes.

Figure 5:
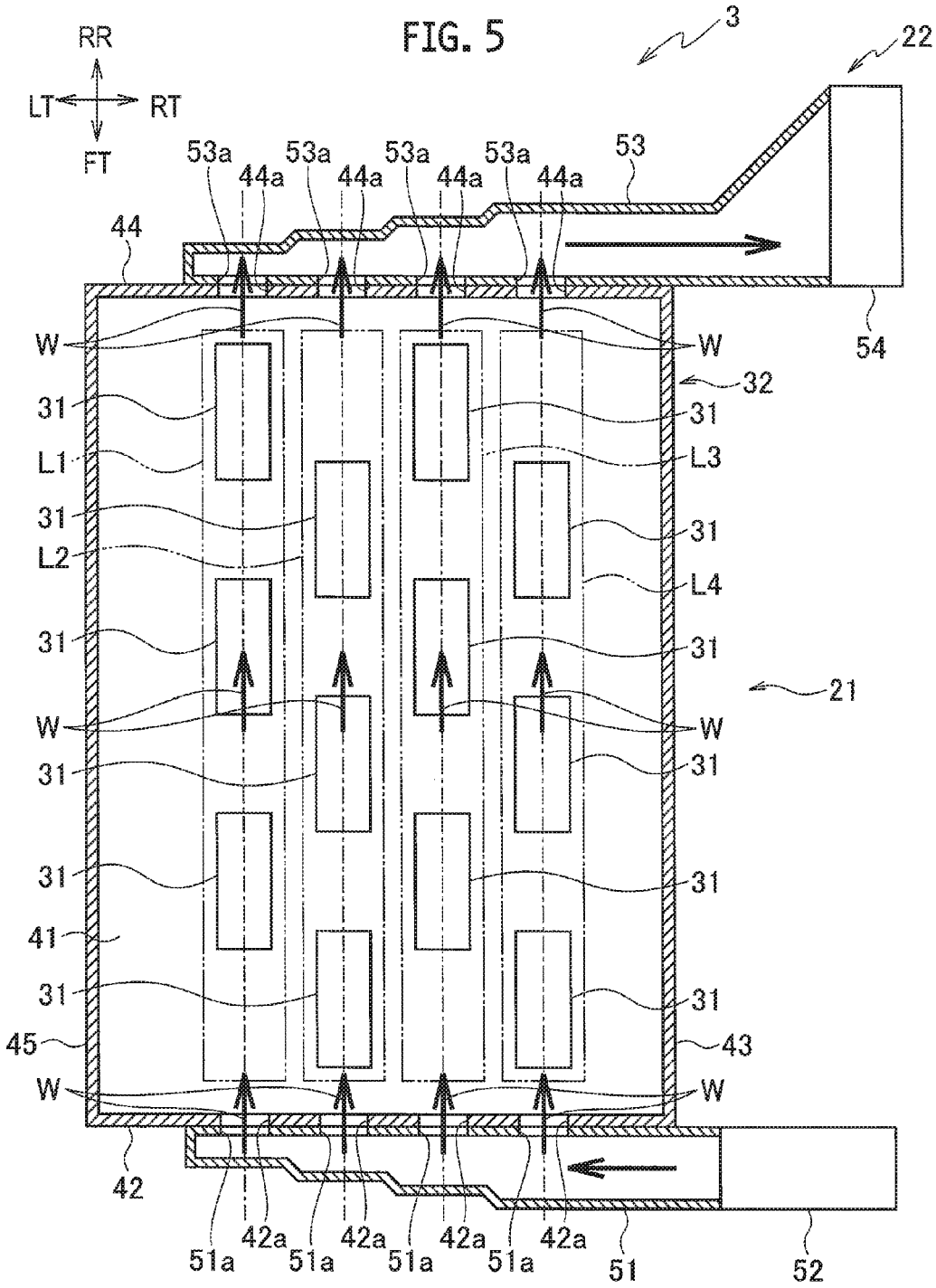
FIG. 5 is a view illustrating a cooling wind generated by a cooler.

Moreover, the controller 4 activates the blow fan 52 and the suction fan 54. The drive of the blow fan 52 causes air to be blown to the head arrays L1 to L4 through the ventilation holes 51*a* of the blow chamber 51 and the ventilation holes 42*a* of the side plate 42 of the head holder 32. Meanwhile, the drive of the suction fan 54 causes air to be sucked out from the head holder 32 through the ventilation holes 44*a* of the side plate 44 of the head holder 32 and the ventilation holes 53*a* of the suction chamber 53. As illustrated in FIG. 5, a cooling wind W flowing from the front side to the rear side is thus generated in the head holder 32.

As described above, the blow chamber 51 has such a shape that the cross-sectional area of the internal air flow passage decreases toward the left side. The air speed is inversely proportional to the cross-sectional area of the flow passage. The wind generated by the blow fan 52 becomes weaker as the distance from the blow fan 52 increases. However, in a design in which the cross-sectional area of the flow passage decreases as the distance from the blow fan 52 increases as in the blow chamber 51, the air speed can be maintained even at a position far from the blow fan 52. Moreover, as described above, the shape of the blow chamber 51 is designed such that the speeds of the air flows from the respective ventilation holes 51*a* to the head arrays L1 to L4 are even.

Similarly, on the suction side, in a design in which the cross-sectional area of the flow passage decreases as the distance from the suction fan 54 increase as in the suction chamber 53, the air speed can be maintained even at a position where the distance from the suction fan 54 is great. Moreover, as described above, the shape of the suction chamber 53 is designed such that the speeds of the air flows sucked in from the respective ventilation holes 53*a* are even.

Accordingly, the air speed of the cooling wind W generated by the drive of the blow fan 52 and the suction fan 54 is the same among the head arrays L1 to L4.

When the sheets P are fed from a not-illustrated paper feeder to the conveyer 2, the sheets P are conveyed while being sucked and held by the transfer belt 11. The controller 4 prints images on the sheets P conveyed below the head unit 21 by ejecting the inks from the inkjet heads 31. When the specified number of sheets to be printed is two or more, the controller 4 prints images by causing the inks to be ejected from the inkjet heads 31 to each of the sheets P sequentially fed and conveyed on the transfer belt 11.

When the inkjet heads 31 are driven, the inkjet heads 31 generate heat but are cooled by the cooling wind W. As described above, since the cooling wind W flows to the head arrays L1 to L4 at the same air speed, the inkjet heads 31 are evenly cooled.

When the blow chamber 51 and the suction chamber 53 have such shapes that the internal air passage has a uniform cross-sectional area unlike the embodiment, the cooling wind becomes weaker as the distance from the blow fan 52 and the suction fan 54 to each of the head arrays increases. Accordingly, the inkjet heads 31 are unevenly cooled.

When the inkjet heads 31 are unevenly cooled, failures may occur. For example, there is a risk that the viscosity of the ink varies among the inkjet heads 31 and an ejection speed thereby varies among the inkjet heads 31, which causes disturbance in printed images. Moreover, for example, there is a risk that some of the inkjet heads 31 become too hot and break. Furthermore, for example, there is a risk that some of the inkjet head 31 are cooled too much and ink mist increases.

Meanwhile, in the inkjet printer 1, since the inkjet heads 31 are evenly cooled, failures like the ones described above are prevented.

After exiting the conveyer 2, the printed sheets P are conveyed to a not-illustrated paper discharger and are discharged. When the last sheet P is discharged, the controller 4 stops the drive roller 12 and also stops the sheet suction fan 17. Moreover, the controller 4 stops the blow fan 52 and the suction fan 54. The printing operation is thereby completed.

As described above, in the inkjet printer 1, the blow chamber 51 has such a shape that the internal air flow passage has cross-sectional areas at the positions of the ventilation holes 51*a* decreasing with the increase in the distance of the ventilation holes 51*a* from the blow fan 52. Moreover, the suction chamber 53 has such a shape that the internal air flow passage has cross-sectional areas at the positions of the ventilation holes 53*a* decreasing with the increase in the distance of the ventilation holes 53*a* from the suction fan 54. This can reduce unevenness in the air speed of the cooling wind W among the head arrays L1 to L4. As a result, unevenness in the cooling of the inkjet heads 31 can be reduced.

Moreover, in the inkjet printer 1, since the cooler 22 cools the inkjet heads 31 by using only one fan and one chamber on each of the blow side and the suction side, an increase in an apparatus size can be suppressed.

Accordingly, the inkjet printer 1 can reduce the unevenness in the cooling of the inkjet heads 31 while suppressing the increase in the apparatus size.

Modified Example of First Embodiment

Figure 6:
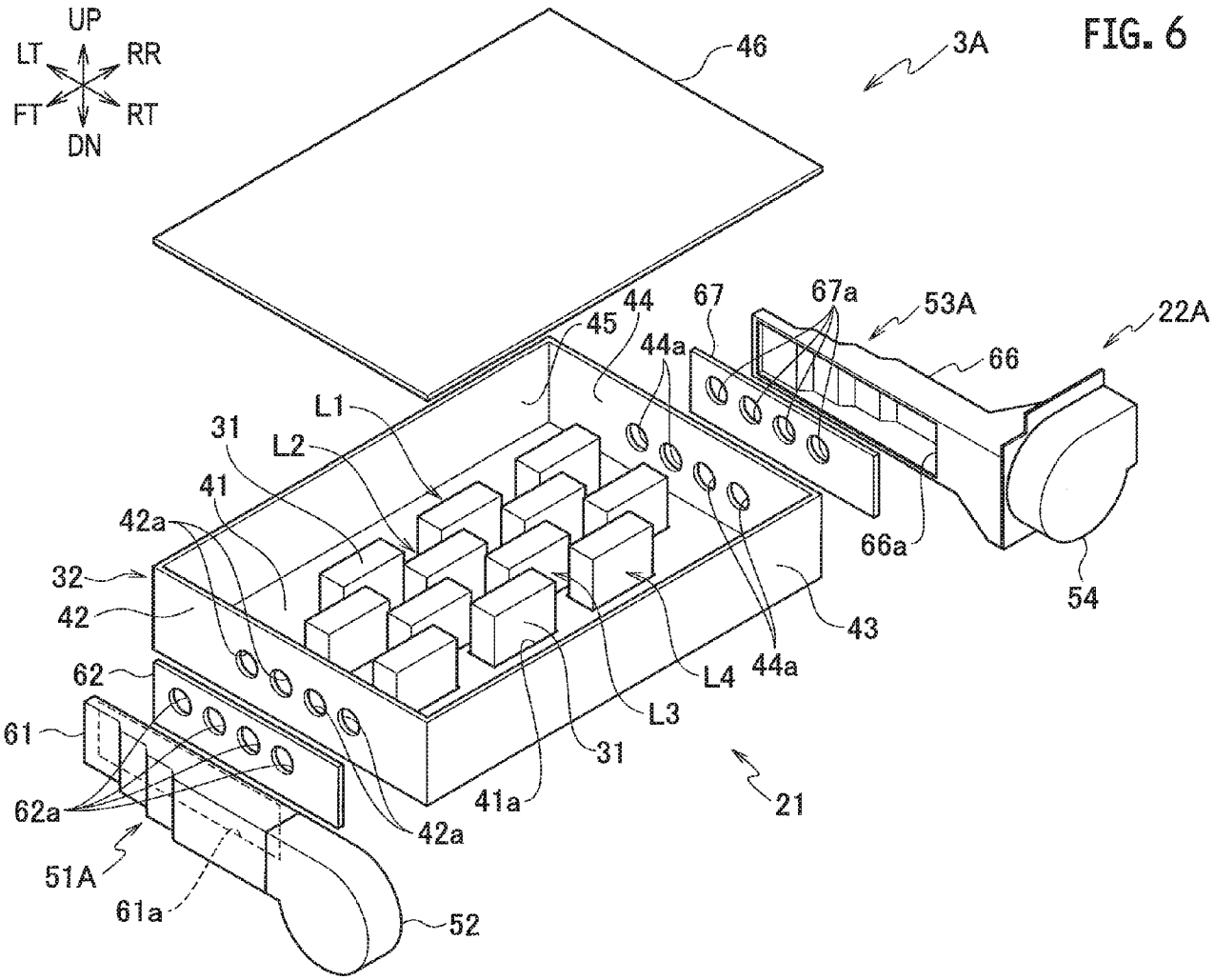
FIG. 6 is an exploded perspective view of a printing unit in a modified example of the first embodiment.

Next, description is given of a modified example in which the blow chamber and the suction chamber in the aforementioned first embodiment are modified. FIG. 6 is an exploded perspective view of a printing unit in the modified example.

As illustrated in FIG. 6, the printing unit 3A in the modified example has a configuration in which the cooler 22 of the printing unit 3 in the aforementioned first embodiment is replaced by a cooler 22A. The cooler 22A has a configuration in which the blow chamber 51 is replaced by a blow chamber 51A and the suction chamber 53 is replaced by a suction chamber 53A in the cooler 22 in the first embodiment.

The blow chamber 51A includes a blow chamber main body 61 and a frame 62.

The blow chamber main body 61 has a configuration in which most of the surface of the blow chamber 51 in the first embodiment facing the side plate 42 of the head holder 32 is opened to form an opening 61*a*. The blow chamber main body 61 is attached to the side plate 42 of the head holder 32 via the frame 62.

The frame 62 is a frame for attaching the blow chamber main body 61 to the side plate 42 of the head holder 32. The frame 62 covers the opening 61*a* of the blow chamber main body 61 and is arranged on the side plate 42. Four ventilation holes 62*a* are formed in the frame 62.

The ventilation holes 62*a* are air outlets from the blow chamber 51A used when air is blown to the inkjet heads 31. The ventilation holes 62*a* are arranged at positions corresponding to the ventilation holes 42*a* of the side plate 42. In other words, the four ventilation holes 62*a* are formed respectively on the extend lines of the head arrays L1 to L4. The four ventilation holes 62*a* all have the same size.

Moreover, the ventilation holes 62*a* are arranged at such positions that the depth of the blow chamber main body 61 at the position of each of the ventilation holes 62*a* decreases toward the left side. The depth of the blow chamber main body 61 in the front-rear direction at the position of each of the ventilation holes 62*a* is designed such that speeds of air flows from the respective ventilation holes 62*a* to the head arrays L1 to L4 are even.

The suction chamber 53A includes a suction chamber main body 66 and a frame 67.

The suction chamber main body 66 has a configuration in which most of the surface of the suction chamber 53 in the first embodiment facing the side plate 44 of the head holder 32 is opened to form an opening 66*a*. The suction chamber main body 66 is attached to the side plate 44 of the head holder 32 via the frame 67.

The frame 67 is a frame for attaching the suction chamber main body 66 to the side plate 44 of the head holder 32. The frame 67 covers the opening 66*a* of the suction chamber main body 66 and is arranged on the side plate 44. Four ventilation holes 67*a* are formed in the frame 67.

The ventilation holes 67*a* are air inlets to the suction chamber 53A used when air is sucked out from the head holder 32. The ventilation holes 67*a* are arranged at positions corresponding to the ventilation holes 44*a* of the side plate 44. In other words, the four ventilation holes 67*a* are formed respectively on the extended lines of the head arrays L1 to L4. To put it differently, the ventilation holes 67*a* are arranged to face the ventilation holes 62*a* of the blow chamber 51A.

Moreover, the ventilation holes 67*a* are arranged at such positions that the depth of the suction chamber main body 66 at the position of each of the ventilation holes 67*a* decreases toward the left side. The depth of the suction chamber main body 66 in the front-rear direction at the position of each of the ventilation holes 67*a* is designed such that speeds of air flows sucked from the ventilation holes 67*a* are even.

The unevenness in the air speed of the cooling wind W among the head arrays L1 to L4 can be reduced also by the cooler 22A having the blow chamber 51A and the suction chamber 53A as described above.

Note that it is possible to employ a configuration in which the frames 62 and 67 are omitted and the blow chamber main body 61 and the suction chamber main body 66 are directly attached to the side plates 42 and 44, respectively. In this case, the blow chamber main body 61 and the side plate 42 form the blow chamber. Meanwhile, the suction chamber main body 66 and the side plate 44 form the suction chamber.

Second Embodiment

Figure 7:
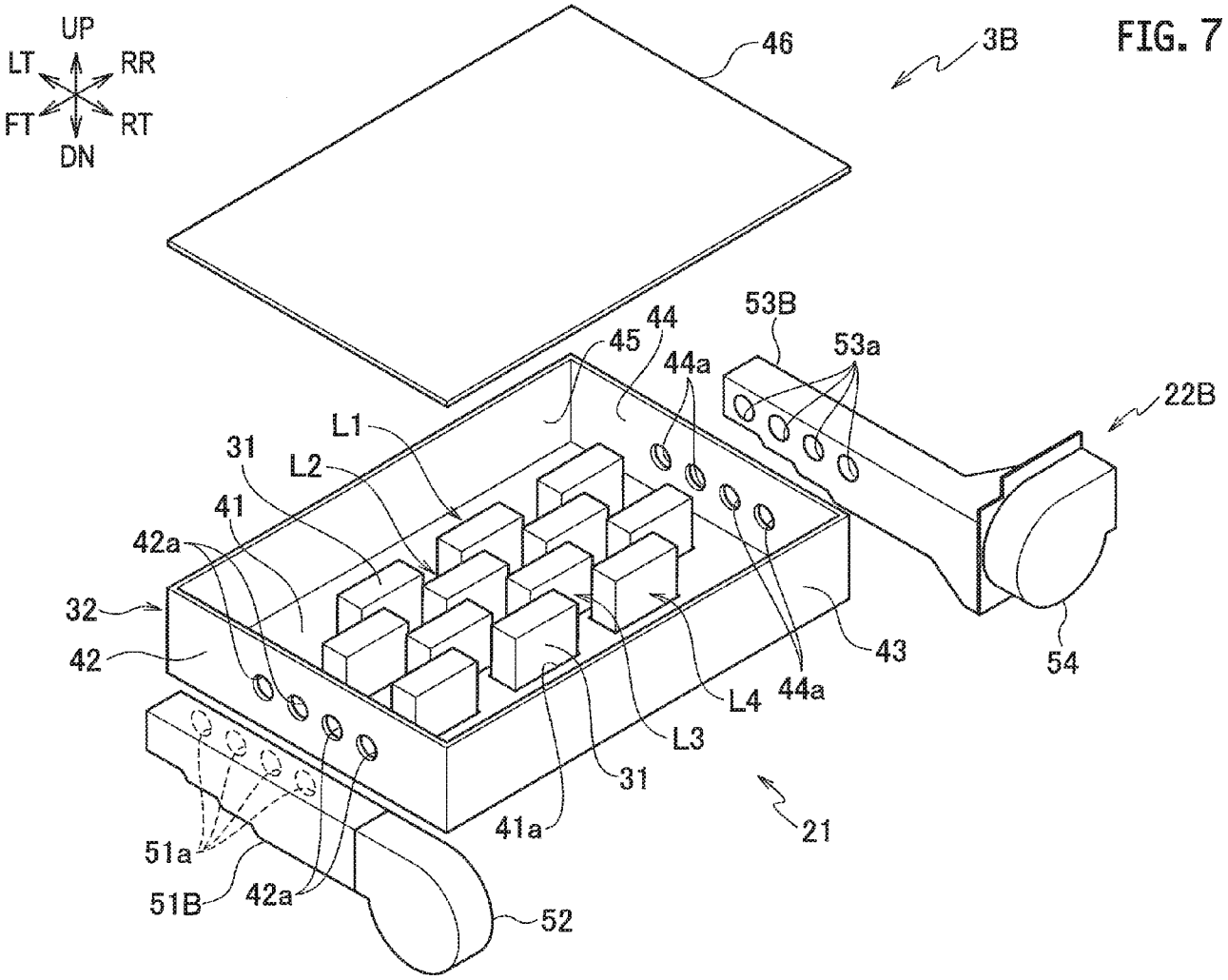
FIG. 7 is an exploded perspective view of a printing unit in a second embodiment.
Figure 8:
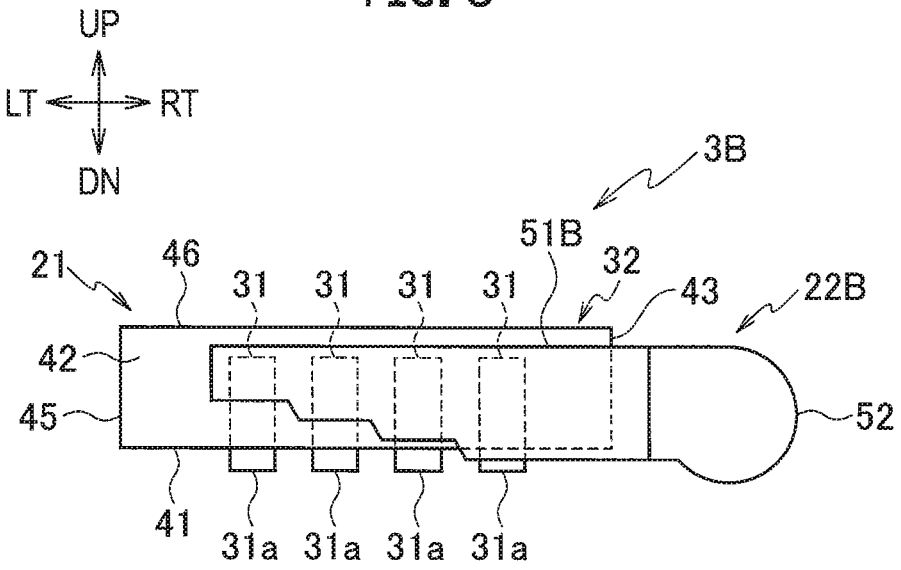
FIG. 8 is a front view of the printing unit in the second embodiment.
Figure 9:
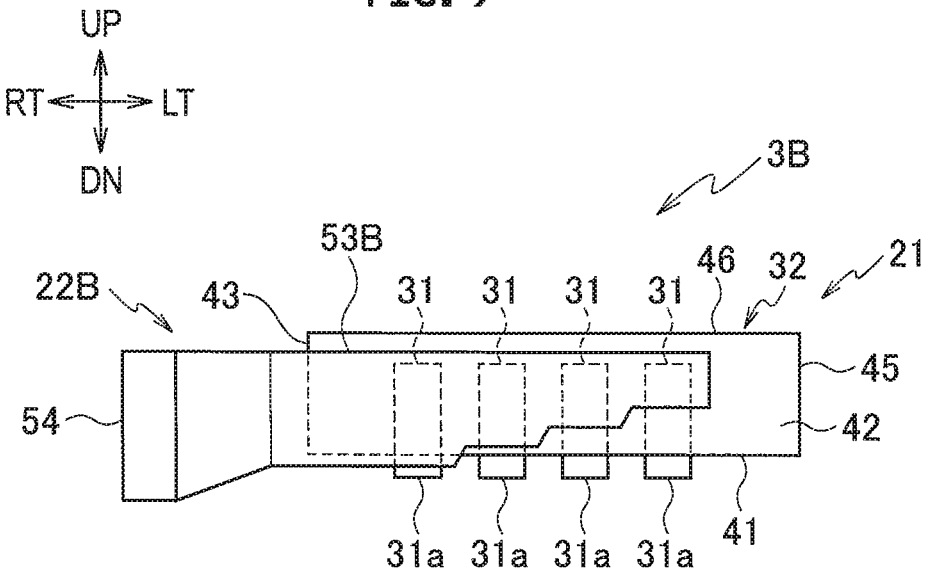
FIG. 9 is a rear view of the printing unit in the second embodiment.

Next, description is given of a second embodiment in which the printing unit of the aforementioned first embodiment is modified. FIG. 7 is an exploded perspective view of the printing unit in the second embodiment. FIG. 8 is a front view of the printing unit in the second embodiment. FIG. 9 is a rear view of the printing unit in the second embodiment.

As illustrated in FIG. 7, the printing unit 3B in the second embodiment has a configuration in which the cooler 22 of the printing unit 3 in the aforementioned first embodiment is replaced by a cooler 22B. The cooler 22B has a configuration in which the blow chamber 51 is replaced by a blow chamber 51B and the suction chamber 53 is replaced by a suction chamber 53B in the cooler 22 in the first embodiment.

As illustrated in FIGS. 7 and 8, the blow chamber 51B is formed in such a shape that the width of the blow chamber 51B in an up-down direction at the position of each of the ventilation holes 51*a* decreases toward the left side. The blow chamber 51B thus has such a shape that the internal air flow passage has cross-sectional areas at the positions of the ventilation holes 51*a* decreasing with the increase in the distance of the ventilation hole 51*a* from the blow fan 52. The width of the blow chamber 51B in the up-down direction at the position of each of the ventilation holes 51*a* is designed such that the speeds of the air flows from the respective ventilation holes 51*a* to the head arrays L1 to L4 are even.

As shown in FIGS. 7 and 9, the suction chamber 53B is formed in such a shape that the width of the suction chamber 53B in the up-down direction at the position of each of the ventilation holes 53*a* decreases toward the left. The suction chamber 53B thus has such a shape that the internal air flow passage has cross-sectional areas at positions of the ventilation holes 53*a* decreasing with the increase in the distance of the ventilation holes 53*a* from the suction fan 54. The width of the blow chamber 53B in the up-down direction at the position of each of the ventilation holes 53*a* are designed such that the speeds of the air flows sucked from the respective ventilation holes 53*a* are even.

The unevenness in the air speed of the cooling wind W among the head arrays L1 to L4 can be reduced also by the cooler 22B having the blow chamber 51B and the suction chamber 53B as described above.

Accordingly, the second embodiment can reduce the unevenness in the cooling of the inkjet heads 31 while suppressing the increase in the apparatus size as in the first embodiment.

As in the modified example of the first embodiment, it is possible to use a blow chamber including: a blow chamber main body in which most of a surface of the blow chamber 51B facing the side plate 42 is opened to form an opening: and a frame in which four ventilation holes are formed. Moreover, it is possible to use a suction chamber including: a suction chamber main body in which most of a surface of the suction chamber 53B facing the side plate 44 is opened to form an opening; and a frame in which four ventilation holes are formed. Moreover, a blow chamber main body and a suction chamber main body like those described above may be directly attached to the side plates 42 and 44, respectively.

OTHER EMBODIMENTS

In the first and second embodiments described above, each of the head arrays L1 to L4 includes three inkjet heads 31. However, the number of inkjet heads included in each head array is not limited to this. Each head array may include one long inkjet head.

In the first embodiment and its modified example described above, the blow chambers 51 and 51A and the suction chambers 53 and 53A have such shapes that the depth in the front-rear direction decreases toward the left side. Moreover, in the second embodiment, the blow chamber 51B and the suction chamber 53B have such shapes that the width in the up-down direction decreases toward the left side. However, the shapes of the blow chamber and the suction chamber are not limited to the shapes described above. The blow chamber can have any shape as long as the internal air flow passage has cross-sectional areas at positions of the ventilation holes decreasing with the increase in the distance of the ventilation holes from the blow fan. Moreover, the suction chamber can have any shape as long as the internal air flow passage has cross-sectional areas at positions of the ventilation holes decreasing with the increase in the distance of the ventilation holes 53*a* from the suction fan.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a plurality of inkjet heads arranged in a plurality of head arrays;

a first chamber having a plurality of first ventilation holes of a same size arranged on extended lines of the plurality of head arrays respectively, the first chamber extending in a direction orthogonal to the extended lines;

a blow fan configured to send air into the first chamber from a first end of the first chamber;

a second chamber facing the first chamber across the plurality of head arrays and having a plurality of second ventilation holes of a same size facing the plurality of first ventilation holes, the second chamber extending in the direction orthogonal to the extended lines; and a suction fan configured to suck air from a second end of the second chamber on a same side as a side of the first end of the first chamber, wherein the first chamber has a shape with cross-sectional areas of an internal air flow passage in the first chamber at positions of the first ventilation holes decreasing with an increase in a distance of the first ventilation holes from the first end, and the second chamber has a shape with cross-sectional areas of an internal air flow passage in the second chamber at positions of the second ventilation holes decreasing with an increase in a distance of the second ventilation holes from the second end.

* * * * *